US012269643B2

(12) United States Patent
Simons et al.

(10) Patent No.: US 12,269,643 B2
(45) Date of Patent: Apr. 8, 2025

(54) SUSTAINABLE RACK AND DISPLAY SYSTEM

(71) Applicant: Multi Packaging Solutions, Inc., Lansing, MI (US)

(72) Inventors: Andrew Simons, Lansing, MI (US); Jeff Williams, Lansing, MI (US); Shane Wright, Lansing, MI (US); Rick T. Vulgamott, Brighton, MI (US); Aaron McDonald, Lansing, MI (US); Shannon Hoover, Lansing, MI (US)

(73) Assignee: Multi Packaging Solutions, Inc., Lansing, MI (US)

( * ) Notice: Subject to any disclaimer, the term of this patent is extended or adjusted under 35 U.S.C. 154(b) by 0 days.

(21) Appl. No.: 18/360,121

(22) Filed: Jul. 27, 2023

(65) Prior Publication Data

US 2024/0017879 A1 Jan. 18, 2024

Related U.S. Application Data

(63) Continuation of application No. 17/902,680, filed on Sep. 2, 2022, now Pat. No. 11,713,160.

(Continued)

(51) Int. Cl.
*B65D 19/00* (2006.01)
*B65D 19/38* (2006.01)

(52) U.S. Cl.
CPC ..... *B65D 19/0012* (2013.01); *B65D 19/385* (2013.01); *B65D 2519/00019* (2013.01); *B65D 2519/00054* (2013.01); *B65D 2519/00194* (2013.01); *B65D 2519/00228* (2013.01); *B65D 2519/00273* (2013.01);

(Continued)

(58) Field of Classification Search
CPC .. B65D 19/0012; B65D 19/385; B65D 19/00; B65D 71/0092; B65D 71/0096; B65D 5/50; B65D 5/52; B65D 25/10; B65D 5/5213; B65D 21/0209; B65D 21/00; B65D 19/38; B65D 2519/00019; B65D 2519/00089
USPC ..... 206/386, 503, 512, 600, 736, 756, 764, 206/765, 767, 774; 220/510; 229/120.06, 120.23, 120.24, 120.25, 229/120.26, 120.27, 120.31, 120.34, 229/120.36, 120.38
See application file for complete search history.

(56) References Cited

U.S. PATENT DOCUMENTS 3,249,071 A 5/1966 Ansingh
3,460,790 A * 8/1969 Baird ..... A47B 65/00 297/440.13

(Continued)

*Primary Examiner* — Rafael A Ortiz
(74) *Attorney, Agent, or Firm* — Neil G. Cohen; Rohini K. Garg

(57) ABSTRACT

A pallet comprising: (a) a base tray having one or more walls extending upward from the tray to create a perimeter around a central portion of the base tray; (b) an insert disposed on the central portion of the tray within the perimeter of the base tray, the insert being recessed from a terminal edge of the one or more walls; (c) a post secured within the perimeter of the tray and extend away from the base tray; and (d) a support assembly secured to the insert and positioned along the central portion of the base tray free of contact with the one or more walls, wherein the support includes a pair of support panels that are interconnected and secured to the insert free of an adhesive.

20 Claims, 6 Drawing Sheets

Related U.S. Application Data

(60) Provisional application No. 63/389,518, filed on Jul. 15, 2022.

(52) U.S. Cl.
CPC ..... *B65D 2519/00288* (2013.01); *B65D 2519/00318* (2013.01); *B65D 2519/00537* (2013.01); *B65D 2519/00542* (2013.01); *B65D 2519/00567* (2013.01); *B65D 2519/0097* (2013.01)

(56) References Cited

U.S. PATENT DOCUMENTS

| | | | | |
|---|---|---|---|---|
| 5,125,568 | A | 6/1992 | Bauer | |
| 5,330,094 | A | 7/1994 | Mertz | |
| 5,992,735 | A | 11/1999 | Oosterbaan | |
| 6,513,705 | B1 | 2/2003 | Sheffer | |
| 6,868,968 | B1 | 3/2005 | Casanovas | |
| 7,066,342 | B2 | 6/2006 | Baechle et al. | |
| 7,513,365 | B2 | 4/2009 | Cornelius et al. | |
| 7,681,735 | B2 * | 3/2010 | Youell, Jr. ..... | B65D 19/20 206/599 |
| 8,833,573 | B2 | 9/2014 | Tomaszewski et al. | |
| 9,655,446 | B2 | 5/2017 | Brady et al. | |
| 9,718,575 | B2 * | 8/2017 | Bourdin ..... | B65D 5/22 |
| 9,783,333 | B1 * | 10/2017 | De Los Santos ..... | B65D 5/006 |
| 9,826,843 | B1 * | 11/2017 | Tomaszewski ..... | B65D 5/5035 |
| 10,278,497 | B2 | 5/2019 | Brady et al. | |
| 10,315,798 | B2 | 6/2019 | Pfeifer et al. | |
| 10,745,171 | B2 | 8/2020 | Pfeifer et al. | |
| 10,750,866 | B2 | 8/2020 | Grupenhof | |
| 10,772,442 | B2 | 9/2020 | Mertz, II et al. | |
| 10,835,058 | B2 | 11/2020 | Sale | |
| 11,267,609 | B2 | 3/2022 | Pfeifer et al. | |
| 2006/0151410 | A1 * | 7/2006 | Lowry ..... | B65D 21/0215 211/126.16 |
| 2006/0243784 | A1 * | 11/2006 | Glaser ..... | B65D 5/5035 229/122.34 |
| 2009/0032432 | A1 | 2/2009 | Kostos et al. | |
| 2013/0180941 | A1 * | 7/2013 | Tomaszewski ..... | B65D 19/385 211/126.12 |
| 2013/0313145 | A1 * | 11/2013 | Gilfert ..... | B65D 5/5088 53/472 |
| 2016/0368660 | A1 * | 12/2016 | Pfeifer ..... | B65D 19/0012 |
| 2019/0116994 | A1 * | 4/2019 | Mertz, II ..... | A47F 5/116 |
| 2019/0152645 | A1 | 5/2019 | Herbeck et al. | |
| 2020/0024032 | A1 | 1/2020 | Urban et al. | |
| 2020/0277103 | A1 | 9/2020 | Kiolbasa | |
| 2021/0016927 | A1 | 1/2021 | Boutwell | |
| 2021/0078781 | A1 | 3/2021 | Spadavecchia et al. | |
| 2021/0393053 | A1 | 12/2021 | Veraza Osorio | |

* cited by examiner

SUSTAINABLE RACK AND DISPLAY SYSTEM

CROSS-REFERENCE TO RELATED APPLICATIONS

This application is continuation of U.S. application Ser. No. 17/902,680, filed Sep. 2, 2022, which claims priority to and the benefit of U.S. Provisional Application Ser. No. 63/389,518 filed Jul. 15, 2022, the entire disclosures of which are incorporated by reference herein.

FIELD

The present teachings generally relate to a pallet system, and more particularly, to a stackable and reinforced pallet system made from sustainable materials.

BACKGROUND

The packaging industry is often required to design packaging materials for various types of products. Similarly, packaging materials may often need to not only safely transport the products between locations but also provide a display system for the products. That is, the products may be packaged within the packaging materials, transported from a manufacturing location to a commercial location (e.g., a retail store), and then placed on display within the packaging materials. As a result, the packaging materials may frequently be required to sufficiently support and/or protect the products during transportation yet still be sufficiently open so that a customer may easily view the products and remove the products from the display.

A common packaging material used to transport and display products may be a pallet. The pallet may include one or more trays having open sides so that the trays may be easily transported yet still openly display the products at a commercial location. However, such conventional products may frequently lack sufficient support or reinforcement to ensure products remain undamaged during transportation. Similarly, such pallets may often be fragile and unable to stack on top of one another. Thus, the pallets may require significant storage space during transportation, during display within a commercial location, or both.

Thus, there remains a need for an improved pallet design. What is needed is a reinforced pallet that ensure products remain intact during transportation and/or commercial display. Furthermore, there remains a need for a pallet that is easily manufactured with more environmentally friendly. What is needed is a pallet made from sustainable materials that requires little assembly yet still provides sufficient support for products. Additionally, there remains a need for a pallet that is able to stack on top of other pallets. What is needed is a reinforced pallet that may be used to create a multi-tiered pallet assembly.

SUMMARY

The present teachings meet one or more of the present needs by providing a pallet comprising: (a) a base tray having one or more walls extending upward from the tray to create a perimeter around a central portion of the base tray; (b) an insert disposed on the central portion of the tray within the perimeter of the base tray, the insert being recessed from a terminal edge of the one or more walls; (c) a post secured within the perimeter of the tray and extend away from the base tray; and (d) a support assembly secured to the insert and positioned along the central portion of the base tray free of contact with the one or more walls, wherein the support includes a pair of support panels that are interconnected and secured to the insert free of an adhesive.

The one or more walls may extend perpendicular to the central portion of the base tray. The post may extend perpendicular to the central portion of the base tray substantially parallel to the one or more walls. The insert may include a chamfer located at a corner of the insert so that, upon insertion into the base tray, the chamfer and the one or more walls of the base tray may form a recess. The post may be inserted into the recess to secure the post to the base tray. Similarly, a cross-section of the post may be complimentary in shape to the recess. Moreover, a height of the post may be greater than a height of the one or more walls.

The pallet may include a cap tray disposed on an opposing end of the post such that the post may be sandwiched between the cap tray and the base tray, and the cap tray and the base tray may be substantially parallel to each other. Moreover, the insert may include a slot, and a portion of the support assembly may be inserted into the slot to secure the support assembly to the insert. The pair of support panels may include an insertion portion projecting from a peripheral edge of the pair of support panels that is inserted into the slot. The pair of support panels may each include a cutout, and the cutouts of the pair of support panels may be engaged to one another to form the support assembly.

The post may be formed from a unitary piece of material, and the piece of material may include a plurality of fold lines so that the piece of material is folded along the fold lines to form the post. Moreover, a cross-section of the post may be triangular in shape. Additionally, the one or more walls of the base tray may be integrally formed with the central portion of the base tray. The one or more walls may include a plurality of panels connected to the base tray by a fold line, and the one or more walls may be formed by folding the panels along the fold lines. Moreover, the pallet may be made from an environmentally friendly paperboard material.

A cross-sectional shape of the support assembly may be substantially X-shaped. Additionally, each of the pair of support panels may include a central fold line bisecting a first portion and a second portion of the support panel so that, when the first portion and the second portion are folded along the fold line and mated to each other, a cutout of the first portion may align with a cutout of the second portion. Similarly, the first portion and the second portion may each include an insertion portion extending from a peripheral edge so that, when the first portion and the second portion are folded along the fold line and mated to each other, the insertion portion of the first portion may align with the insertion portion of the second portion. Moreover, a plurality of pallets may be stackable to form a multi-tiered pallet assembly.

The present teachings may meet one or more of the present needs by providing: an improved pallet design; a reinforced pallet that ensure products remain intact during transportation and/or commercial display; a pallet that is easily manufactured with more environmentally friendly; a pallet made from sustainable materials that requires little assembly yet still provides sufficient support for products; a pallet that is able to stack on top of other pallets; a reinforced pallet that may be used to create a multi-tiered pallet assembly; or a combination thereof.

DETAILED DESCRIPTION

Figure 1:
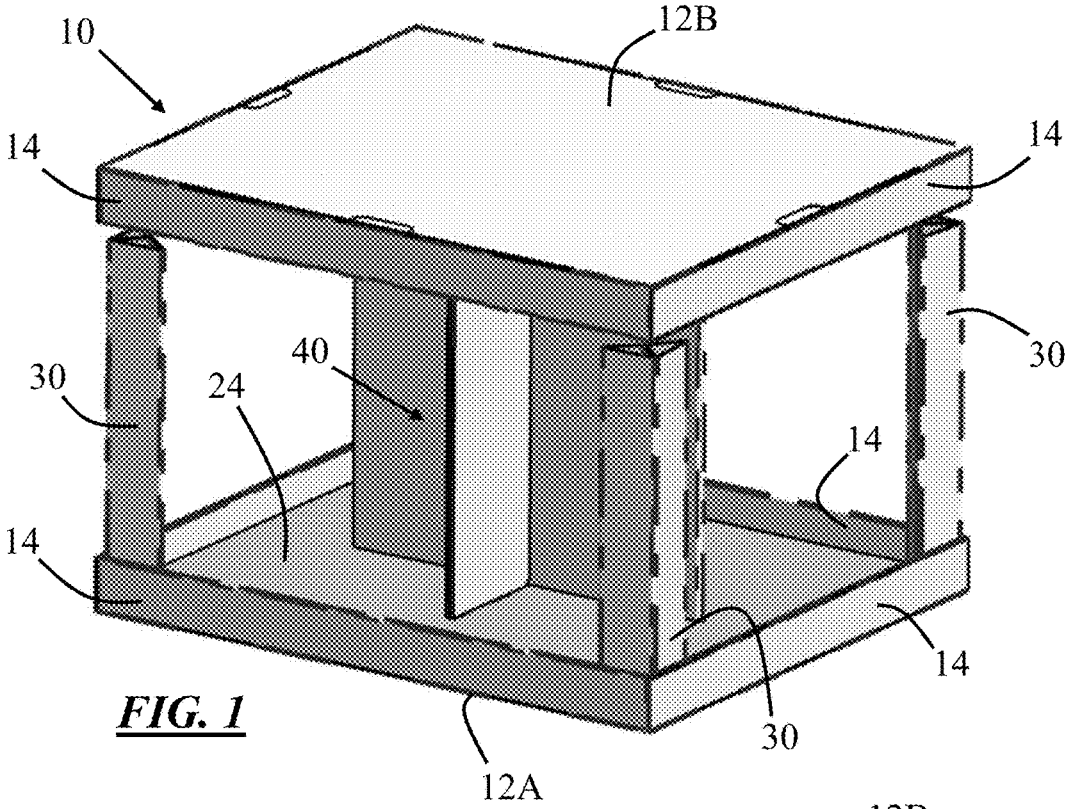
FIG. 1 is a perspective view of a pallet in accordance with the present teachings.

The present teachings generally relate to packaging. More particularly, the present teachings relate to a pallet utilized for packaging one or more items. The pallet may package one or more items for transportation between locations. During transportation, it is envisioned that the pallet may maintain the integrity of the one or more items being transported, thereby preventing damage and/or degradation to the one or more items. As such, the pallet may be structurally reinforced or otherwise designed to sufficiently support the one or more items being transported. It should be noted that the pallet may be implemented in various industries for transporting a variety of items, such as, but not limited to: the agriculture industry (e.g., plants, horticulture items, gardening items, etc.); the construction and/or home improvement industry (e.g., construction materials, tools, building materials, etc.); the electronics industry (e.g., packaged video games, movies, music, etc.); the food and beverage industry; other consumer retail industries (e.g., board games, toys, clothing, jewelry, sporting goods, etc.); or a combination thereof.

Additionally, the pallet may also provide a display system for the one or more items being transported. That is, once the items reach their destination (e.g., a commercial retail establishment), the pallets may be placed to display the items for prospective customers. Therefore, the pallet may beneficially provide an efficient manner of displaying the items being transported without requiring the items to be removed from the pallet and placed in a secondary display or shelving unit. As such, the pallet may be sufficiently sturdy and reinforced to support the items during transportation and continued display of the items. Moreover, the pallet may also provide a structure that does not obstruct view of the items being displayed. That is, the pallet may include one or more open sides, open panels, windows, cutouts, or a combination thereof to ensure customers can easily view the items stored therein.

Furthermore, it is envisioned that the pallet as described herein may also allow for stacking of a plurality of pallets to create a multi-tiered pallet assembly. The pallets may be stacked similar to a conventional box to minimize the floorspace needed for display, optimize packaging of the pallets during transportation, or both. For example, the pallets may be stacked to create a two-tiered pallet assembly (e.g., one pallet stack on top of another pallet), a three-tiered pallet assembly (e.g., three pallets stacked on top of each other), a four-tiered pallet assembly, a five-tiered pallet assembly, or even a six-tiered pallet assembly. However, a height or number of stacked pallets within a tiered assembly may not be limited. That is, the pallets may be sufficiently reinforced and structured to withstand the weight of stacking additional pallets depending on the items being transported and/or displayed.

The pallet may include one or more trays. The trays may function to support the items being transported and/or displayed. The trays may at least partially define an interior region of the pallet where the items may be located. The trays may provide a base surface in which to support the items during transportation and/or display. Similarly, the trays may also provide a top cap or panel above the items to prevent damage of the items from above. Moreover, trays provided as a top cap may also facilitate stacking of the pallets.

For example, the pallet may include a tray base and a tray cap. The tray base may support the items from below while the tray cap may be positioned above the items stored within the pallet. As a result, the items may be confined between the tray base and the tray cap. Moreover, the pallets may thus be stackable so that a tray base of a second pallet is supported by the tray cap of a first pallet.

The tray may include one or more walls. The walls may function to create a perimeter around a central region of the tray. The walls may function to provide a lip at least partially surrounding the tray to ensure items located along the central region of the tray remain within the central region of the tray. That is, the walls may prevent items from falling out or off the pallet.

The walls may be integrally formed with the tray as a unitary piece of material. As a result, the walls may beneficially extend directly from the tray (e.g., a central portion of the tray). The walls may extend substantially perpendicular to a surface of the tray, such as a support surface or central region of the tray that supports the items. However, the walls may also extend at an angle other than perpendicular relative to the surface of the tray.

To create the walls, one or more wall panels connected to the tray may be folded relative to each other, relative to the central portion of the tray, or both. That is, the tray may come as a unitary piece that requires folding and interconnection for assembly. However, advantageously, such assembly may be completed without the use of tools or secondary fasteners, thereby ensuring a quick and cost-effective assembly process.

To reinforce that tray, one or more inserts may be placed within the perimeter of the walls of the tray. As such, the insert may be disposed along a surface of the tray within the perimeter of the walls to support the items. Thus, the inserts may increase the structural integrity of the tray relative to supporting the items during transportation and/or display.

The insert may be a panel having a similar or same shape as a central portion of the tray. The insert may have a shape similar to a shape formed by the perimeter of the tray (e.g., the walls). The insert may have a thickness the same as, greater than, or less than, a thickness of the tray along the central portion. Similarly, a plurality of inserts may be stacked and positioned within the perimeter of the tray. One or more, two or more, or three or more inserts may be disposed on the tray. Six or less, five or less, or four or less inserts may be disposed on the tray. Thus, a number of inserts may be predicated on the items being transported and/or displayed. Similarly, adjusting the number of inserts used may also adjust a height of the items within the pallet to extend them farther above the walls of the tray.

The insert may also include one or more chamfers. The chamfers may function to define an outer perimeter shape of the insert. The chamfers may be located near one or more of the corners of the insert along its perimeter. For example, the insert may be rectangular, and a chamfer may be located at each of the four corners of the rectangular perimeter of the insert. However, the chamfer could be located at various other locations depending on the shape of the insert. It is envisioned that the chamfer may truncate a corner (e.g., a joining or two peripheral perimeter edges) of the insert so that, when the insert is disposed on top of the tray, a portion of the tray in line with the chamfered region of the insert is free of coverage from the insert.

Additionally, the chamfers of the insert may also form a recess with the walls of the tray. That is, when one or more inserts are disposed on top of the central portion of the tray, the chamfer may interconnect or partially abut one or more walls of the tray to form a recess. A depth of the recess may be defined as a distance from a top surface of the insert or top-most insert and the top surface of the central portion of the tray. As such, a depth of the recess may be adjusted based upon the number of inserts disposed on top of the central portion of the tray.

The recess may function to secure a post of the pallet. The recess may maintain a position of the post such that the post abuts the central portion of the tray. It is envisioned that the post may be seeded in the recess and extend perpendicular to the central portion of the tray and/or the insert therein. As such, the post may contact or engage the central portion of the tray, one or more walls or the tray, the insert, or a combination thereof to maintain a position of the post.

A shape of the recess may be defined by the one or more walls of the tray and the insert that create the recess. However, it is contemplated that the recess may have a shape that is complimentary to a shape of the post. As a result, the post may be secured within the recess free of unwanted movement relative to the tray.

The post may function as a support for one or more trays. The post may support a tray cap disposed over a top of the items being support on a tray base. The post may define a distance or gap between the tray cap and the tray base, thereby defining a region therebetween where items may be located for transportation and/or display.

Similarly, the post may also function to support one or more additional pallets when the pallets are in a multi-tiered pallet assembly. As such, a second pallet or a plurality of pallets is stacked on top of a first pallet, the post of the first pallet may at least partially support the pallets stacked thereon, thereby preventing the first pallet from being crushed and damaging the items therein.

Similar to the tray, the post may be made from a unitary piece of material. As such, the post may include one or more panels or sections interconnected by fold lines. When the fold lines are utilized to fold panels or sections relative to each other, an overall shape of the post may be formed. Advantageously, such assembly may be completed without the use of tools or secondary fasteners. Additionally, such folding may also facilitate a reinforcement of the post extending along a length (e.g., height) of the post to ensure the post is not easily crushed during use.

A single post or a plurality of posts may be utilized in the pallet design. For example, a post may be located at each of the four corners of the pallet if a shape of the pallet is substantially cube-shaped. However, any number of posts may be utilized depending on an overall pallet shape. Regardless of the number of posts used, it is envisioned that a shape and structure of the post is created to sufficiently reinforce and support the pallet or additional pallets stacked thereon yet minimally obstruct the view of items located within the pallet. Therefore, the post or posts may be particularly adapted for securing within recesses formed by the insert and tray located along a perimeter of the tray (e.g., near the perimeter walls) free of intrusion on the central region of the tray supporting the items therein.

The pallet may also include a support assembly. The support assembly may function to reinforce the pallet. The support assembly may function to support additional pallets stacked on top of the pallet. As such, the support assembly may prevent crushing of the pallet or portions of the pallet, such as the posts, when supporting additional weight, thereby preventing damage of the items stored therein.

The support assembly may vary is size and/or shape. However, the support assembly may have an overall height the same as the posts when the pallet is fully assembled. That is, while separate the post may have a height greater than or less than the support assembly, when the pallet is fully assembled, the support assembly and the posts may project from the tray and/or insert to reach the same distance. As a result, a second tray (e.g., a tray cap) may be disposed along the posts and the support assembly and contact both the posts and the support assembly to ensure that the second tray is substantially parallel to the first tray (e.g., a tray base).

The support assembly may include one or more support panels. While the number of support panels that form the support assembly is not limited, for illustrative purposes the support assembly may include a first support panel and a second support panel. The support panels may function to interconnect and form an overall shape of the support assembly.

The support panels may interconnect to form the support assembly. An overall shape of the support assembly may be dictated by the support panels interconnection. The support panels may be connected free of secondary fasteners (e.g., adhesives, mechanical fasteners, etc.) to one another to form the support assembly. For example, the support panels may have a notch, cutout, hole, projection, or a combination thereof that locks the support panels to each other to form the support assembly. Similarly, it is envisioned that some or all of the support panels include a portion or feature that facilitates connection of the support assembly to the tray, the insert therein, or both.

The support panels may also include one or more fold lines to facilitate folding of portions of the support panels relative to each other. As a result, a unitary piece of material may be at least partially folded onto itself to increase a thickness of the support panel. Thus, the support panels may be easily formed for final assembly and further reinforce the support assembly.

The fold lines as discussed above with respect to the tray, the post, and the support assembly may be any crease, localized material thickness decrease, scoring, perforation, or a combination thereof within the components mentioned above. That is, any part of the pallet may include fold lines to facilitate assembly of the components and/or assembly of the final pallet. As such, the fold lines may extend or be located anywhere along any of the surfaces of the pallet components.

Turning now to the figures, FIG. 1 illustrates a perspective view of a pallet 10 in accordance with the present teachings. The pallet 10 includes a pair of trays 12 spaced apart from one another to define an interior region of the pallet. Such interior region may be adapted to receive one or more items for transport, display, or both. As shown, the pallet 10 may include a tray base 12A and a tray cap 12B. The tray base 12A may be adapted to support the items located within the pallet 10 during transportation and/or display.

Each tray 12 may include one or more walls 14. The walls 14 may be located along an outer region of the tray 12 to form a perimeter of the tray 12. Similarly, the walls 14 may extend or project from the tray 12 to create a lip around the central region of the tray 12. Thus, items stored within the pallet 10 may be prevented from accidentally sliding out of the pallet 10 during transportation and/or display.

The trays 12 may be spaced apart relative to one another such that the walls 14 of the tray cap 12B and the walls 14 of the tray base 12A converge towards one another, yet still provide substantially open sides in which to view or display the items within the pallet 10. As such, the walls 14 or a portion of the walls 14 of the tray base 12A and the tray cap 12B may be substantially coplanar to each other while also being substantially perpendicular to the central region of the trays 12. For example, as shown, the walls 14 of each tray 12 may form a rectangular shape. As a result, each side of the tray cap 12B may have a wall 14 that is coplanar with a wall 14 of the tray base 12B on that same respective side. Thus, the trays 12 may be complimentary in shape to form the overall shape of the pallet 10

A distance between the trays 12 may be defined by a length of one or more posts 30. The posts 30 may be secured to each of the trays 12 and connect the trays 12 together to form the overall shape of the pallet 10. As shown, a post 30 is located at each corner of the trays 12. However, any number of posts 30 may be utilized depending on the size and/or shape of the pallet 10. It should also be noted that FIG. 1 illustrates the tray cap 12B floating above the posts 30 and not secured to the posts 30 yet for illustrative purposes.

Additionally, an insert 24 may be located within the tray base 12A and disposed along the central portion of the tray base 12A that support supports the items located therein (items not shown). The insert 24 may be complimentary in shape to the central portion of the tray base 12A so that the insert 24 is secured by the perimeter formed from the walls 14 of the tray base 12A.

Furthermore, the pallet 10 may include a support assembly 40. The support assembly 40 may be disposed or secured to the insert 24 and/or the trays 12. The support assembly 40 may be configured to reinforce or support the central region of the tray base 12A and/or the tray cap 12B. The support assembly 40 may also be free or contact with the posts 30 of the pallet 10 to provide sufficient space for the items stored within the pallet 10.

Figure 2:
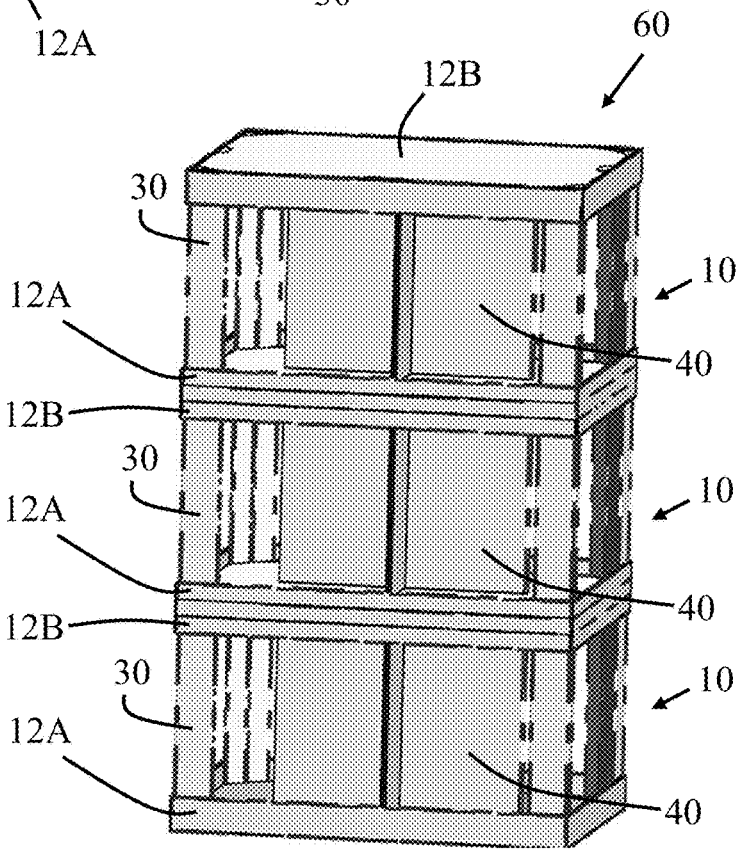
FIG. 2 is a perspective view of a multi-tiered pallet assembly in accordance with the present teachings.

FIG. 2 illustrates a perspective view of a multi-tiered pallet assembly 60. As shown, a plurality of pallets 10 are stack on top of one another to form a three-tiered pallet assembly 60. Advantageously, posts 30 and support assemblies 40 located within each of the pallets 10 may support the weight of the additional pallets 10 stacked on top.

As discussed above, each pallet 10 may include a tray base 12A and a tray cap 12B. The tray base 12A of one pallet 10 may be supports or disposed on a tray cap 12B of an adjacent pallet 10 to allow for stacking. As such, an outer surface of the tray bases 12A and the tray caps 12B may be complimentary in shape and/or coplanar to allow for stacking of the pallets 10, thereby forming the multi-tiered pallet assembly 60.

Figure 3:
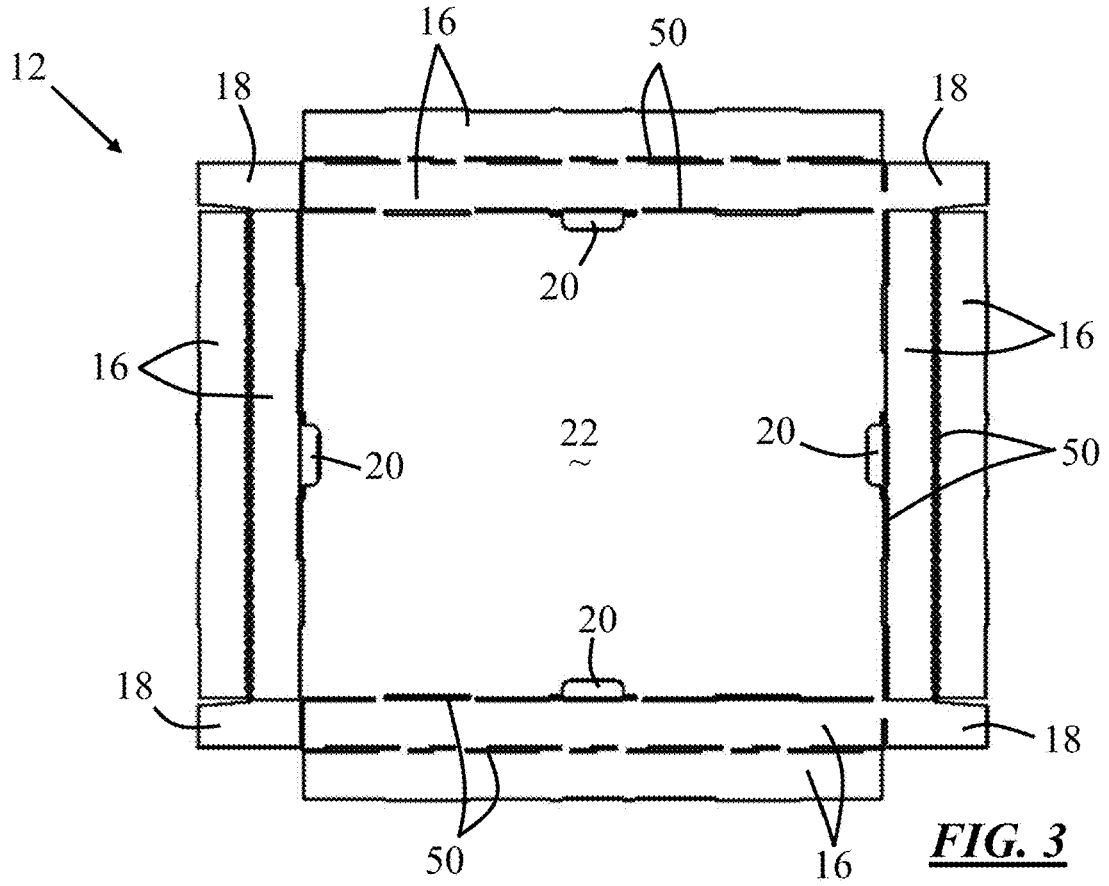
FIG. 3 is a front view of a tray of a pallet in an unfolded state.

FIG. 3 illustrates a front view of a tray 12 of the pallet as discussed above. The tray 12 is shown in an unfolded or flat state prior to assembly of the tray 12. It should also be noted that the tray 12 may be a tray cap or a tray base of a pallet. Therefore, to simplify assembly and manufacturing, the tray caps and the tray bases may be the same geometry and may only be dictated by location within the pallet.

The tray 12 may include a central portion 22. The central portion 22 may be adapted to support items within the pallet when located on a tray base. Similarly, the central portion 22 may also support additional pallets when the pallets are stacked (e.g., a central portion 22 or a tray cap). The central portion 22 may be connected to a plurality of wall panels 16 extending from a periphery of the central portion 22. The walls panels 16 may be connected to the central portion 22 and each other by a plurality of fold lines 50. As a result, the tray may be made from a unitary piece of material.

To assembly the tray 12, the wall panels 16 may be folded along the fold lines 50 relative to each other and relative to the central portion 22. As a result, walls may be formed that extend from a perimeter of the central portion 22 substantially perpendicular to a top or bottom surface of the central portion 22 (see, e.g., FIG. 1). Additionally, it should be noted that the fold lines 50 may also be perforated or include score lines that receive an edge of the outermost wall panels 16 and secure the walls in place. For example, the outermost exposed edge of the walls panels 16 may include notches or projections that are secured within the fold lines 50 or another feature of the tray 12, such as cutouts 20 of the tray 12. However, other connection means may be possible.

Furthermore, the tray 12 may include a plurality of tabs 18. The tabs 18 may be connected to one or more of the wall panels 16 by fold lines 50 so that the tabs 18 are adapted to fold relative to the wall panels 16. As a result, the tabs 18 may be interconnected to the wall panels 16 to reinforce the walls in their final assembled state.

Figure 4:
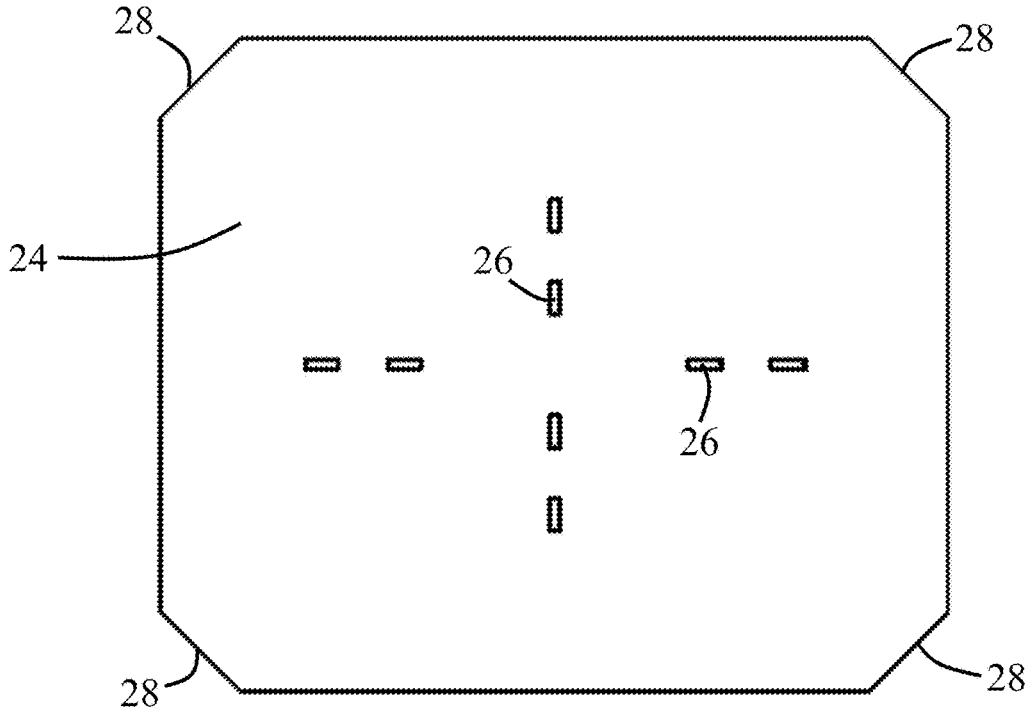
FIG. 4 is a front view of an insert of a pallet.

FIG. 4 illustrates a front view of an insert 24. As discussed above, the insert 24 may be adapted for insertion into the confines of a tray so that the insert 24 is disposed along a surface of the tray. The insert 24 may vary in size and/or shape depending on the shape of the tray. However, for illustrative purposes, the insert 24 may be rectangular in shape. Each corner along the perimeter of the insert 24 may include a chamfer 28 that creates a flat edge at each corner. As discussed in further detail below, the chamfers 28 may be adapted to interconnect or abut the walls of the tray to form a recess with the tray.

The insert 24 may also include one or more slots 26. The slots 26 may be adapted to secure a support assembly of the pallet. The slots 26 may be located anywhere along the insert 24 to align with a portion of the support assembly. Additionally, it should also be noted that a plurality of inserts 24 may be stacked on top of each other for assembly, whereby the chamfers 28 and the slots 26 may align.

Figure 5:
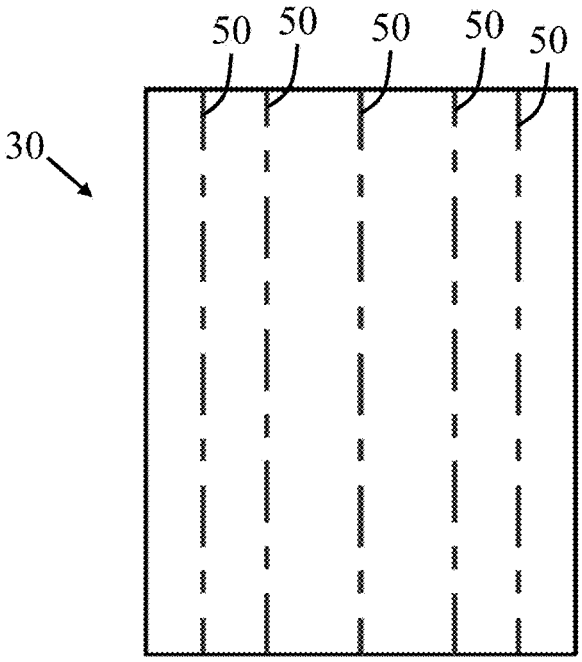
FIG. 5 is a front view of a post of a pallet in an unfolded state.

FIG. 5 illustrates a front view of a post 30 in an unfolded or unassembled state. The post 30 may beneficially be formed from a unitary piece of material. That is, portions of the material may be folded or manipulated relative to each other to assembly and form the structure of the post 30. As shown, a plurality of fold lines 50 separate segments of the post 30 material. Once the segments are folded relative to one another along the fold lines 50, an overall structure of the post 30 may be easily formed without the use of tools or secondary fasteners.

Figure 6:
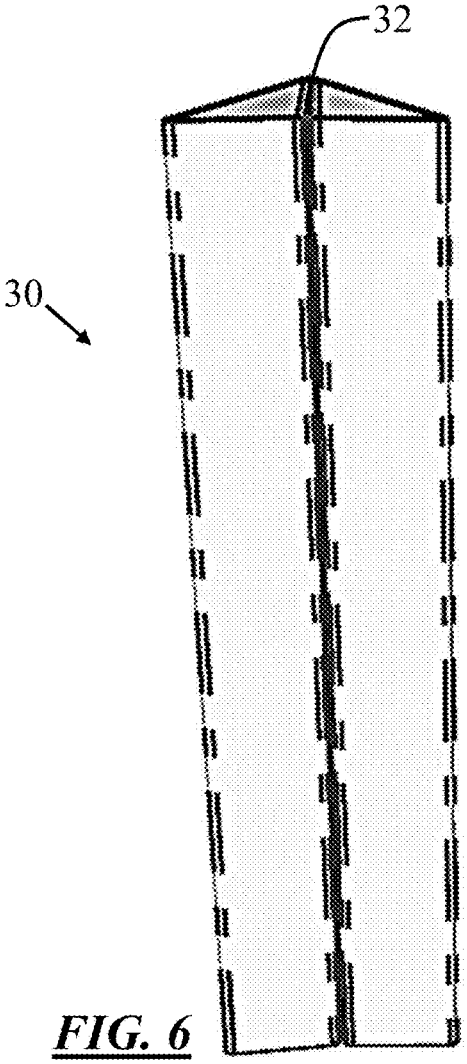
FIG. 6 is a perspective view of the post of FIG. 5.

FIG. 6 illustrates a perspective view of the post 30 shown in an unfolded stated in FIG. 5. Once the segments are folded relative to each other along the fold lines, an overall structure of the post 30 may be formed. As shown, the post may have a substantially triangular cross section. However, any shape may be suitable for such assembly depending on the pallet design. Additionally, as the segments of the unitary material are folded to form the post 30, one or more of the sections may fold inward within the confines of the post 30 to create a post reinforcement 32. The post reinforcement 32 may further improve the structural integrity of the post 30 and increase a load capacity of each post 30. The post reinforcement 32 may extend along a length of the post 30. That is, the post reinforcement 32 may extend partially or entirely a long a length of the post 30 between terminal ends of the post 30. Thus, the post reinforcement 32 may reinforce an entirety of the post 30 or may locally reinforce a portion of the post 30.

Moreover, as can be seen in FIG. 6, the post 30 may include one or more open ends such that an interior of the posts 30 may be accessible if desired. However, an end cap or a closed surface may also be present along one or more terminal ends of the post 30.

Figure 7A:
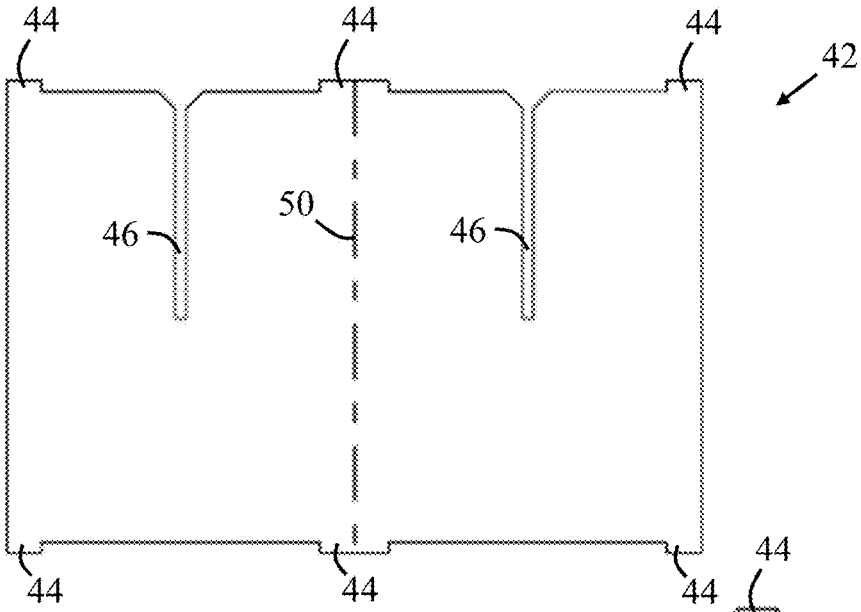
FIG. 7A is a front view of a support panel in an unfolded state.
Figure 7B:
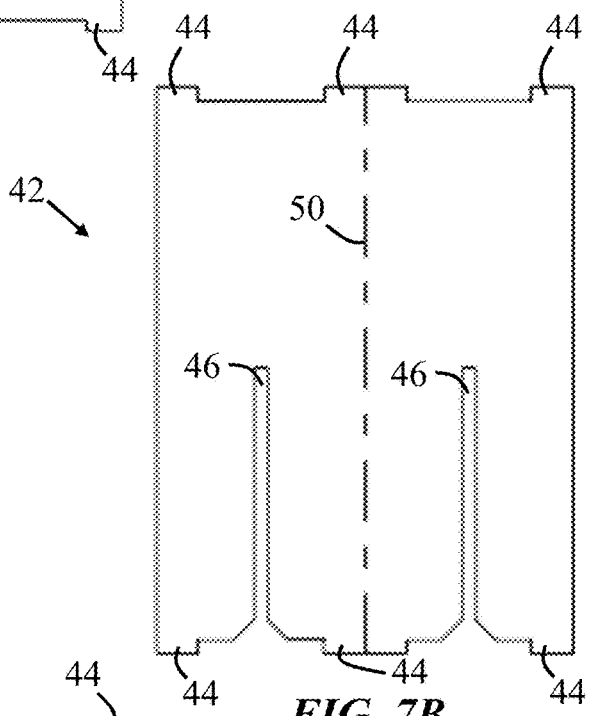
FIG. 7B is a front view of a support panel in an unfolded state.
Figure 7C:
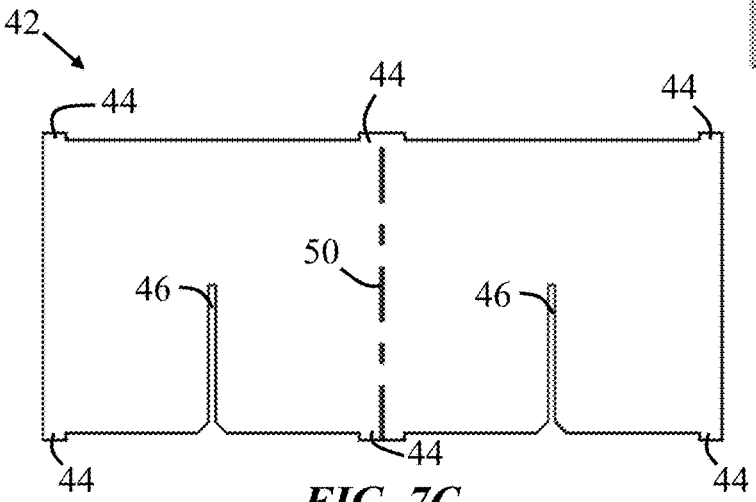
FIG. 7C is a front view of a support panel in an unfolded state.

FIGS. 7A-7C illustrate front views of various support panels 42 in an unfolded state. As discussed above, one or more support panels 42 may be interconnected to form a support assembly of the pallet (see FIG. 1).

As shown, the support panels 42 may vary in size and/or shape. That is, a width and/or a height of the support panels 42 may vary to accommodate various configurations of the final pallet assembly. Therefore, the interconnected support panels 42 that create the support assembly may be the same dimensionally or may vary in dimensions.

The support panels 42 may include a fold line 50 extend between a top edge and a bottom edge of the panel along a height of the support panel 42. The fold line 50 may bisect two portions of the support panel 42 so that, when folded relative to each other, a first portion and a second portion of the support panels 42 are folded onto one another and essential decreasing an overall width of the unfolded support panel 42 in half. As a result, a thickness of the support panel 42 may be easily increased for increased structural integrity.

Each of the first and second segments of the support panel 42 as defined by the fold line 50 may include a cutout 46. The cutout may be a notch or slot extending from a terminal edge of the support panel 42 towards an inward or central region of the support panel 42. When folded, the cutouts 46 of the first and second segments may align with each other and form an overall cutout the may receive the cutout of a complimentary support panel 42, thereby forming the support assembly.

Similarly, each support panel 42 may also include a plurality of insertion portions 44 located along both the first segment and second segment of each support panel 42. The insertion portions 44 of each segment may be similar to the cutouts 46 in that, after folding the segments, the insertion portions 44 of the first segment may align with complimentary insertion portions 44 of the second segment. Thus, once folded, the abutting and complimentary insertion portions 44 may be adapted for insertion into one or more slots along the insert of the pallet (see FIG. 1) to secure the support assembly to the insert and thus the pallet. It should be noted that the shape of the cutouts 46 and the insertion portion 44 may be any designed shaped. For example, the insertion portions 44 may be complimentary in shape to the slots of the insert to ensure a tight and secure fit when inserted.

Figure 8:
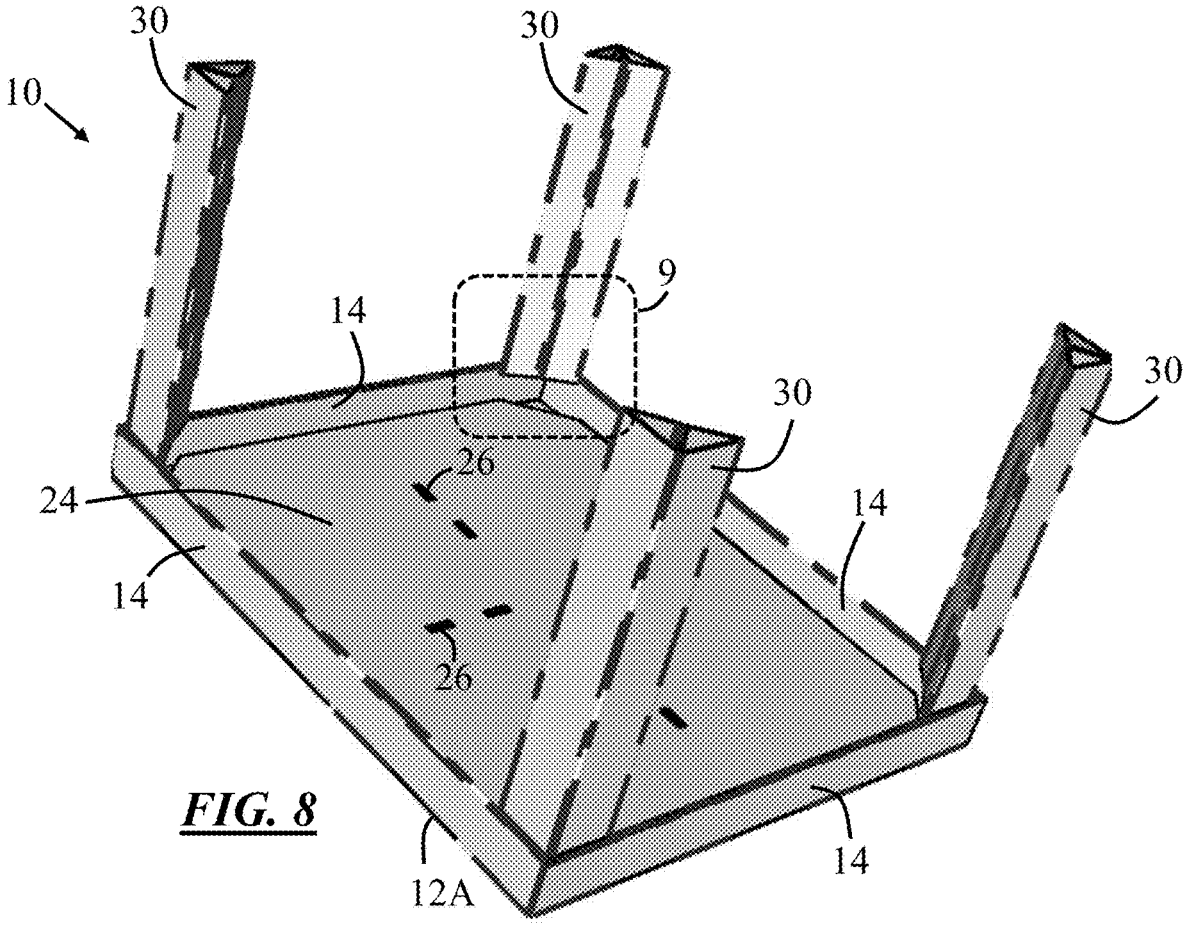
FIG. 8 is a perspective view of a partially assembled pallet in accordance with the present teachings.

FIG. 8 illustrates a perspective view of a partially assembled pallet 10. As shown, a plurality of posts 30 are being connected to the tray so that one or more outer surfaces of the posts 30 abut the walls 14 of the tray 12. In this particular example, a tray base 12A is shown so illustrative purposes. Additionally, as discussed above, an insert 24 may be located within a perimeter of the tray base 12A formed by the walls 14. The insert 24 may include a plurality of slots 26 adapted to receive insertion portions of the support assembly to secure the support assembly in place (see FIGS. 7A-7C).

Figure 9:
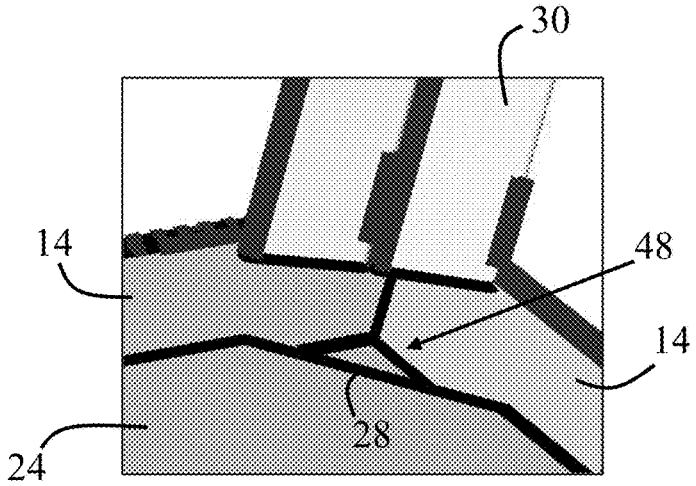
FIG. 9 is close-up view 9 of FIG. 8.

FIG. 9 is close-up view 9 of the partially assembled pallet 10 of FIG. 8. As mentioned above, the insert 24 may be secured within the confines of the tray, as established by the walls 14. The insert 24 may also include one or more chamfers 28 located at corners of the insert. The chamfer 28 may also align with a corner formed by adjoining walls 14 of the tray. As a result, when the insert 24 is inserted into the tray and outer edges of the insert 24 abut inner surfaces of the walls 14, a recess 48 is formed between the walls and the chamfer 28. Advantageously, such a recess 48 may be adapted to receive the post 30 of the pallet, thereby securing the post 30 to the tray and/or insert 24. As such, a terminal end of the post 30 may be inserted into the recess 48 to abut a surface of the tray (e.g., a surface of the central portion of the tray) while outer surfaces along a length of the post 30 may abut an edge of the chamfer 28, one or more surfaces of the walls 14, or a combination thereof.

Additionally, it should be noted that a plurality of inserts 24 may be stacked on top of each other so that a combined thickness of the inserts 24 may created a deeper recess 48. As a result, the plurality of inserts 24 may create a greater engagement between the recess 48 and the post 30 being inserted therein.

Figure 10:
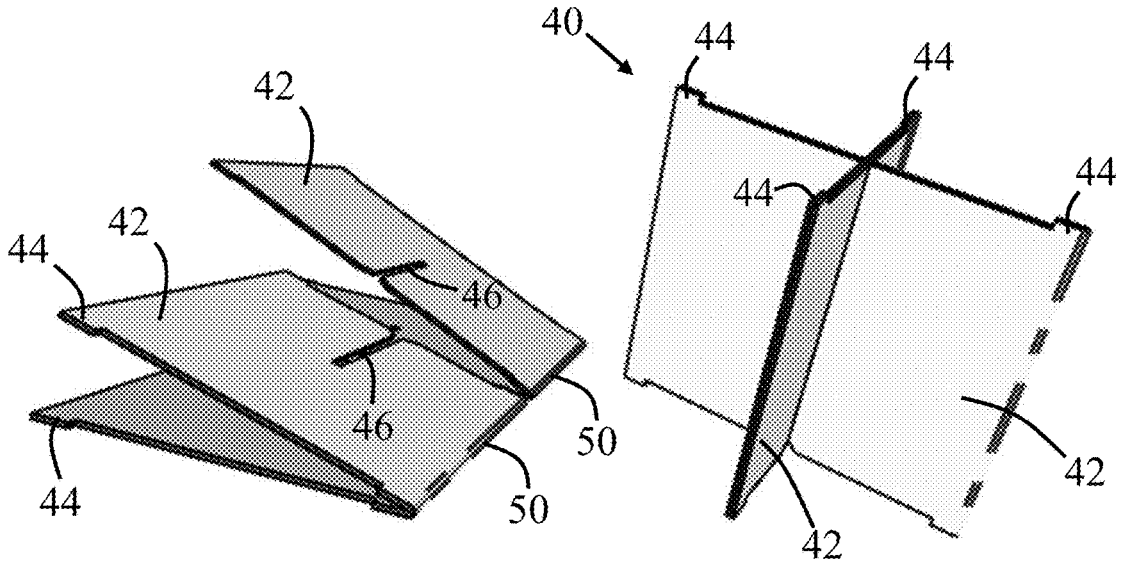
FIG. 10 is a perspective view of a support assembly of a pallet.

FIG. 10 illustrates a perspective view of a support assembly 40. As discussed above, the support assembly 40 may include one or more interconnect support panels 42. Here, for illustrative purposes, the support assembly 40 may include a pair of support panels 42. As shown, each panel 42 may include a fold line 50 such that a first segment and a second segment of the support panels 42 may be folded relative to each other along the fold line 50. As a result, an overall cutout 46 and insertion portions 44 may be formed in each support panel 42. Once the support panels 42 are folded, the cutouts of each support panel 42 may interconnect with each other to form the support assembly 40. The support assembly 40 may in this case include a set of four fins projection from a central point on the support assembly 40 to form an overall X-shaped cross-sectional shape of the support assembly. Additionally, each fin may have the same dimension or may have different dimensions depending on the shape of the pallet. Similarly, while the insertion portions 44 may be located near outer ends of each fin, the insertion portions 44 may be positioned anywhere along the edge of each support panel 42 (e.g., each fin) to align with slots of the insert of the pallet.

Figure 11:
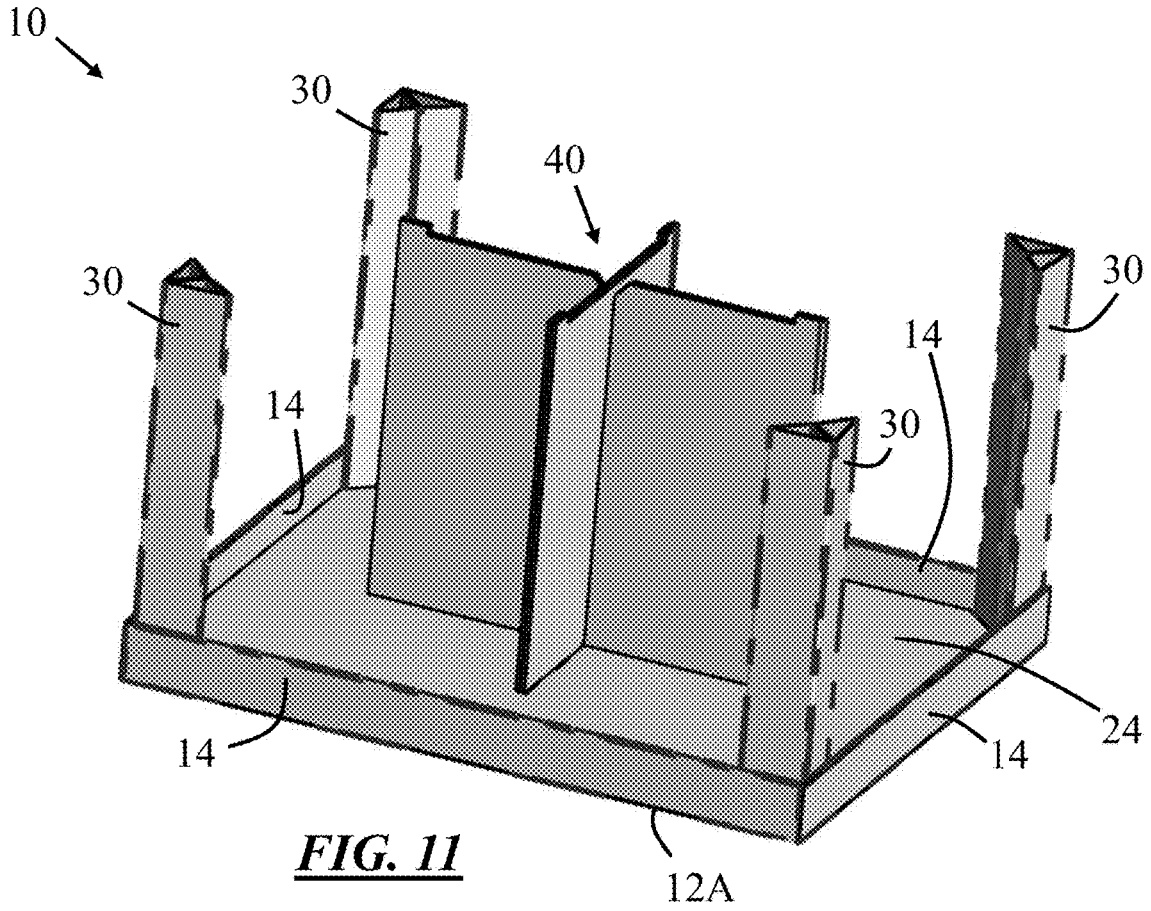
FIG. 11 is a perspective view of a partially assembly pallet in accordance with the present teachings.

FIG. 11 illustrates a perspective view of a partially assembled pallet 10. As discussed above, a plurality of posts 30 may be inserted into recesses formed between the insert 24 and the walls 14 of the tray base 12A. Similarly, the insert may include a plurality of slots (see FIG. 4) that receive the insertion portions 44 of the support assembly 40, thereby securing the support assembly to the tray base 12A and the one or more inserts 24 therein. As such, an additional tray (e.g., a tray cap) may then be placed on an opposing end of the posts 30 and/or the support assembly 40 to complete assembly of the pallet 10.

Additionally, it should be noted that the pallet 10 as described herein may be made form a variety of materials. However, it is envisioned that the pallet 10 may be made from renewable and/or environmentally friendly materials. That is, the materials that form the pallet 10 may be recyclable, may have a substantially decreased carbon footprint relative to conventional pallet material, may be compostable, or a combination thereof. For example, the pallet 10 may be made substantially or entirely from a paperboard material or other renewable paper material.

ELEMENT LIST

10 Pallet
12 Tray
12A Tray Base
12B Tray Cap
14 Tray Wall
16 Tray Wall Panel
18 Tray Tab
20 Tray Cutout
22 Central Portion of the Tray
24 Insert
26 Insert Slot
28 Chamfer of the Insert
30 Post
32 Post Reinforcement
40 Support Assembly
42 Support Panel
44 Insertion Portion
46 Cutout
48 Recess
50 Fold Line
60 Multi-Tiered Pallet Assembly Any numerical values recited herein include all values from the lower value to the upper value in increments of one unit provided that there is a separation of at least 2 units between any lower value and any higher value. As an example, if it is stated that the amount of a component or a value of a process variable such as, for example, temperature, pressure, time and the like is, for example, from 1 to 90, preferably from 20 to 80, more preferably from 30 to 70, it is intended that values such as 15 to 85, 22 to 68, 43 to 51, 30 to 32 etc. are expressly enumerated in this specification. For values which are less than one, one unit is considered to be 0.0001, 0.001, 0.01 or 0.1 as appropriate. These are only examples of what is specifically intended and all possible combinations of numerical values between the lowest value and the highest value enumerated are to be considered to be expressly stated in this application in a similar manner.

Unless otherwise stated, all ranges include both endpoints and all numbers between the endpoints. The use of "about" or "approximately" in connection with a range applies to both ends of the range. Thus, "about 20 to 30" is intended to cover "about 20 to about 30", inclusive of at least the specified endpoints.

The disclosures of all articles and references, including patent applications and publications, are incorporated by reference herein in their entirety for all purposes. The term "consisting essentially of" to describe a combination shall include the elements, ingredients, components or steps identified, and such other elements ingredients, components or steps that do not materially affect the basic and novel characteristics of the combination. The use of the terms "comprising" or "including" to describe combinations of elements, ingredients, components or steps herein also contemplates embodiments that consist essentially of the elements, ingredients, components or steps. By use of the term "may" herein, it is intended that any described attributes that "may" be included are optional.

Unless otherwise stated, a teaching with the term "about" or "approximately" in combination with a numerical amount encompasses a teaching of the recited amount, as well as approximations of that recited amount. By way of example, a teaching of "about 100" encompasses a teaching of 100+/−15.

Plural elements, ingredients, components or steps can be provided by a single integrated element, ingredient, component or step. Alternatively, a single integrated element, ingredient, component or step might be divided into separate plural elements, ingredients, components or steps. The disclosure of "a" or "one" to describe an element, ingredient, component or step is not intended to foreclose additional elements, ingredients, components or steps.

It is understood that the above description is intended to be illustrative and not restrictive. Many embodiments as well as many applications besides the examples provided will be apparent to those of skill in the art upon reading the above description. The scope of the teachings should, therefore, be determined not with reference to the above description, but should instead be determined with reference to the appended claims, along with the full scope of equivalents to which such claims are entitled. The disclosures of all articles and references, including patent applications and publications, are incorporated by reference herein in their entirety for all purposes. The omission in the following claims of any aspect of subject matter that is disclosed herein is not a disclaimer of such subject matter, nor should it be regarded that the inventors did not consider such subject matter to be part of the disclosed inventive subject matter.

What is claimed is:

1. A pallet, comprising:

a base tray that includes one or more walls that form a perimeter of the base tray;

an insert positioned within the perimeter of the base tray, wherein the insert is substantially planar and disposed along a surface of the base tray;

a recess formed by the one or more walls of the base tray and the insert;

a post positioned in the recess that extends away from the base tray; and a support assembly coupled to the insert and spaced apart from the one or more walls of the base tray and the post, wherein the support assembly includes a pair of interconnected support panels that each include a first portion connected to a second portion by a fold line.

2. The pallet of claim 1, wherein the one or more walls of the base tray extend from the surface of the base tray and define a central portion of the base tray located within the perimeter formed by the one or more walls.

3. The pallet of claim 2, wherein the one or more walls of the base tray and the post both extend away from the base tray in the same direction.

4. The pallet of claim 1, wherein the pallet includes a plurality of posts positioned in respective ones of a plurality of recesses, and the plurality of posts are free of connection to one another.

5. The pallet of claim 1, wherein a cross-section of the post is triangular and complementary in shape to the recess.

6. The pallet of claim 1, wherein the insert includes a chamfer along an edge of the insert that forms the recess with the one or more walls of the base tray.

7. The pallet of claim 2, wherein the insert is recessed from an edge of the one or more walls of the base tray.

8. The pallet of claim 1, wherein the post includes an interior portion, and a post reinforcement that is formed with the post, located in the interior portion, and extends along a length of the post.

9. The pallet of claim 1, further comprising:

a cap tray that is disposed on the post such that the post extends between the base tray and the cap tray.

10. The pallet of claim 9, wherein the cap tray is substantially parallel to the base tray.

11. The pallet of claim 1, wherein the post is supported by the surface of the base tray.

12. A pallet assembly, comprising:

a tray that includes a wall that extends from a surface of the tray at least partially around a central portion of the tray;

an insert located in the central portion of the tray;

posts having an outer surface in contact with the wall of the tray, wherein the posts are spaced apart to permit access to the central portion of the tray, the posts each include a post reinforcement connected to a respective one of the posts by a fold line and located in an interior portion of a respective one of the posts, and a terminal end of each of the posts abuts the surface of the tray;

a support assembly coupled to the insert and spaced apart from the wall of the tray and the posts, the support assembly including a first support panel interconnected with a second support panel, wherein the first support panel includes a first insertion portion projecting from a peripheral edge of the first support panel, the second support panel includes a second insertion portion projecting from a peripheral edge of the second support panel, and the first insertion portion of the first support panel and the second insertion portion of the second support panel are inserted into respective slots defined by the insert; and a cap that is supported by the posts and the support assembly and is spaced apart from the tray, wherein the cap includes a wall that extends from a surface of the cap towards the tray.

13. The pallet assembly of claim 12, wherein the first support panel and the second support panel each include a first portion connected to a second portion by a fold line.

14. The pallet assembly of claim 12, wherein the wall of the tray and the wall of the cap converge towards one another.

15. The pallet assembly of claim 12, wherein the wall of the tray is substantially coplanar to the wall of the cap.

16. The pallet assembly of claim 12, wherein the support assembly is spaced apart from the wall of the tray and the wall of the cap, and wherein the first support panel and the second support panel are interconnected to form an X-shaped cross section of the support assembly.

17. A pallet made from an environmentally friendly paperboard material, comprising:

a tray having a wall and an interior region defined by the wall;

an insert positioned in the interior region of the tray; and a support assembly spaced apart from the wall of the tray and secured in a slot of the insert, wherein the support assembly includes:

a first support panel that includes a first cutout; and a second support panel that includes a second cutout, wherein the first cutout receives the second cutout to connect the first support panel to the second support panel and form an X-shaped cross section of the support assembly; and wherein the first support panel and the second support panel each include:

a first portion that includes a first cutout portion; and a second portion that includes a second cutout portion and is connected to the first portion by a fold line, wherein the first cutout portion and the second cutout portion are configured to be folded along the fold line to couple the first portion to the second portion and align the first cutout portion and the second cutout portion to form each of the first cutout and the second cutout of the first support panel and the second support panel, respectively.

18. The pallet of claim 17, wherein the support assembly is configured to support a cap of the pallet, and wherein the pallet is configured to be stacked with additional pallets disposed on, and supported by, the cap of the pallet.

19. The pallet of claim 17, wherein the support assembly extends away from the insert substantially perpendicular to the insert.

20. The pallet of claim 17, wherein the first cutout is a notch extending from a terminal edge of the first support panel and the second cutout is a notch extending from a terminal edge of the second support panel.

* * * * *